US009511468B2

(12) United States Patent
Suzuki

(10) Patent No.: US 9,511,468 B2
(45) Date of Patent: Dec. 6, 2016

(54) BELT-TYPE GRINDING TOOL

(71) Applicant: NITTO KOHKI CO., LTD., Ohta-ku, Tokyo (JP)

(72) Inventor: Yasumasa Suzuki, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 14/835,044

(22) Filed: Aug. 25, 2015

(65) Prior Publication Data

US 2015/0360339 A1 Dec. 17, 2015

Related U.S. Application Data

(63) Continuation of application No. PCT/JP2014/055171, filed on Feb. 28, 2014.

(30) Foreign Application Priority Data

Feb. 28, 2013 (JP) ..... 2013-039740

(51) Int. Cl.
*B24B 23/06* (2006.01)
*B24B 21/20* (2006.01)
*B24B 23/02* (2006.01)

(52) U.S. Cl.
CPC ..... *B24B 23/06* (2013.01); *B24B 21/20* (2013.01); *B24B 23/026* (2013.01)

(58) Field of Classification Search
CPC ..... B24B 23/06; B24B 21/20
USPC ..... 451/355, 311, 296
See application file for complete search history.

(56) References Cited

U.S. PATENT DOCUMENTS 1,108,176 A * 8/1914 Hormel ..... B24B 21/18 451/297
3,594,959 A * 7/1971 Wezel ..... B24B 23/06 451/311
4,368,597 A * 1/1983 Fleckenstein ..... B24B 23/06 451/311

(Continued)

FOREIGN PATENT DOCUMENTS

JP 1-138558 U 9/1989
JP 2-190651 A 7/1990

(Continued)

OTHER PUBLICATIONS

International Search Report in corresponding International Application No. PCT/JP2014/055171, dated Apr. 28, 2014, 5 pages.

*Primary Examiner* — Robert Rose
(74) *Attorney, Agent, or Firm* — Brinks Gilson & Lione

(57) ABSTRACT

Provided is a belt-type grinding tool allowing an endless grinding belt replacement operation to be performed without requiring a large force. A belt-type grinding tool has an endless grinding belt wound around a drive pulley provided in a tool body and an idler pulley rotatably supported by a pulley support bar. The grinding tool has a spring urging the pulley support bar forward relative to the tool body, thereby causing the idler pulley to press the endless grinding belt forward to apply a tension to the endless grinding belt, and a spring support member movably attached to the tool body to support and compress the spring, the spring support member being movable between a first position where the idler pulley applies a tension to the endless grinding belt and a second position where the spring support member is displaced from the first position to reduce the amount of compression of the spring to reduce the tension.

14 Claims, 7 Drawing Sheets

(56) References Cited

U.S. PATENT DOCUMENTS 4,509,296 A * 4/1985 Rasmussen ..... B24B 27/0084 269/74
4,727,685 A * 3/1988 Batt ..... B24B 23/06 451/355
4,977,708 A 12/1990 Kloft
5,185,962 A * 2/1993 Liou ..... B24B 21/20 451/296

FOREIGN PATENT DOCUMENTS

JP 3-154765 A 7/1991
JP 9-19861 A 1/1997
JP 2004-58216 A 2/2004

* cited by examiner

BELT-TYPE GRINDING TOOL

RELATED APPLICATIONS

The present application is a continuation of PCT/JP2014/055171 filed on Feb. 28, 2014, which claims priority to Japanese Application No. 2013-039740 filed on Feb. 28, 2013. The entire contents of these applications are incorporated herein by reference.

TECHNICAL FIELD

The present invention relates to grinding tools. More particularly, the present invention relates to a belt-type grinding tool configured to grind an object by bringing an endless grinding belt being driven to rotate into contact with the object.

BACKGROUND ART

A belt-type grinding tool has a drive pulley rotationally driven by a motor, a rotatable idlerr pulley, and an endless grinding belt wound around the drive pulley and the idlerr pulley and driven to rotate in response to the rotation of the drive pulley. The grinding tool is configured to grind an object by bringing the rotating endless grinding belt into contact with the object. A pulley support bar supporting the idlerr pulley is longitudinally slidably held by a tool body in which the drive pulley is provided, and urged forward by a spring provided in the tool body. Urging force of the spring applies a tension to the endless grinding belt wound around the drive pulley and the idlerr pulley.

The endless grinding belt is an expendable component and needs to be replaced when the belt has become worn to a certain extent as a result of performing grinding operation. In a replacement operation, usually, the pulley support bar is pushed in rearward against the urging force of the spring and held in a retracted position by a lock mechanism. In this state, a cover covering the drive pulley is removed, and removal and installation of an endless grinding belt is performed (Patent Literature 1).

CITATION LIST

Patent Literature

Patent Literature 1: Japanese Patent Application Laid-Open Publication No. 2004-58216

SUMMARY OF INVENTION

Technical Problem

In the above-described endless grinding belt replacement operation, however, the pulley support bar must be pushed in so as to further compress the spring, which has already been compressed to generate urging force in order to apply a tension to the endless grinding belt. Therefore, a relatively large force is required for the replacement operation. The endless grinding belt replacement operation may occasionally need to be performed many times a day, which is troublesome for the worker. Further, it is necessary to provide a lock mechanism or the like to hold the pulley support bar in the pushed-in position, which causes an increase in the number of component parts, resulting in a complicated assembly operation.

Accordingly, an object of the present invention is to solve the above-described problems of the conventional technique and to provide a belt-type grinding tool allowing an endless grinding belt replacement operation to be performed without requiring a large force.

Solution to Problem

The present invention provides a belt-type grinding tool including a tool body, a drive pulley provided in the tool body and rotationally driven by a motor, an idler pulley provided at a position separated forward from the drive pulley to stretch an endless grinding belt between the idler pulley and the drive pulley, a pulley support bar having a front end portion rotatably supporting the idler pulley, the pulley support bar extending rearward from the front end portion and being supported by the tool body, a spring urging the pulley support bar forward relative to the tool body, thereby causing the idler pulley supported by the pulley support bar to press the endless grinding belt forward to apply a tension to the endless grinding belt, and a spring support member movably attached to the tool body, the spring support member being movable between a first position where the spring support member supports the spring in such a manner that the spring is compressed between the spring support member and the pulley support bar to apply a tension to the endless grinding belt, and a second position where the spring support member is displaced from the first position to reduce the amount of compression of the spring to reduce the tension.

In this belt-type grinding tool, force required to retract the pulley support bar rearward is reduced by moving the spring support member to the second position; therefore, it becomes easy to retract the pulley support bar so as to slacken the endless grinding belt by removing tension from the endless grinding belt when replacing the endless grinding belt.

Preferably, the arrangement may be such that the spring support member when in the second position does not press the spring, so that the pulley support bar is movable rearwardly without compressing the spring.

Thus, when the spring support member is in the second position, the pulley support bar is not urged forward by the spring; therefore, the pulley support bar can be moved rearward even more easily. In addition, it becomes unnecessary to provide a lock mechanism for holding the pulley support bar in the rearward position. Accordingly, the number of component parts is reduced, and the assembly operation is facilitated.

Specifically, the arrangement may be as follows. The spring support member is pivotable about a pivot shaft provided on the tool body, so that the spring support member is movable between the first position and the second position by pivoting about the pivot shaft.

Thus, the spring support member is made pivotally movable to function as a cam, thereby making it possible to reduce force required to move the spring support member from the second position to the first position so as to compress the spring.

More specifically, the pivot shaft may be located at a position displaced from the longitudinal axis of the spring.

With the above-described structure, it becomes easy to move the spring-pressing surface of the spring support member sufficiently to increase and decrease the urging force of the spring even in a case where the pivotable angle range of the spring support member is limited.

Alternatively, the arrangement may be as follows. The spring support member is movable in a transverse direction crossing the longitudinal axis of the spring, so that the spring support member is movable between the first position and the second position by moving in the transverse direction.

Preferably, the arrangement may be as follows. The belt-type grinding tool further includes a cover attached to the spring support member. The tool body further has a top front opening for passage of an upper run portion of the endless grinding belt wound around the drive pulley and the idler pulley, a bottom front opening for passage of a lower run portion of the endless grinding belt, and a side opening opened contiguously with the top front opening and the bottom front opening to expose a side portion of the drive pulley. The cover covers the side opening when the spring support member is in the first position. When the spring support member is in the second position, the cover exposes the side opening to allow access to the drive pulley, thereby allowing the endless grinding belt to be mounted around and removed from the drive pulley through the side opening.

Thus, the spring support member and the cover are integrated into one unit, so that the operation of removing tension from the endless grinding belt and the operation of opening the cover to allow access to the drive pulley are completed with a single operation. Accordingly, the endless grinding belt replacement operation is further facilitated. In addition, when the spring support member is moved to the first position to allow the endless grinding belt to be driven to rotate, the drive pulley is covered with the cover simultaneously. Therefore, the endless grinding belt will never be driven to rotate with the drive pulley exposed, which reduces the danger of a worker's hand or the like being accidentally caught between the endless grinding belt being driven to rotate and the drive pulley.

More preferably, the arrangement may be as follows. The pulley support bar has a spring housing hole extending forward from a rear end surface of the pulley support bar and having a front end surface in the pulley support bar. The spring is accommodated in the spring housing hole such that a front end portion of the spring abuts against the front end surface of the spring housing hole.

With the above-described structure, a space capable of disposing the spring can be increased in the longitudinal direction; therefore, it becomes possible to use a relatively long spring. The longer the spring becomes, the easier it becomes to reduce the amount of change in urging force with respect to a change in the amount of compression of the spring. Accordingly, it is possible to reduce the change of urging force when the amount of compression of the spring changes due to a change in the circumferential length of the endless grinding belt as a result of stretching thereof, for example, and hence possible to reduce the change in tension applied to the endless grinding belt.

Preferably, the arrangement may be as follows. The belt-type grinding tool further includes a spring seat member engageable with a rear end portion of the spring, and the spring support member when in the first position engages the spring seat member to press the spring through the spring seat member.

Embodiments of the belt-type grinding tool according to the present invention will be explained below on the basis of the accompanying drawings.

DETAILED DESCRIPTION OF THE PREFERRED EMBODIMENTS

Figure 1:
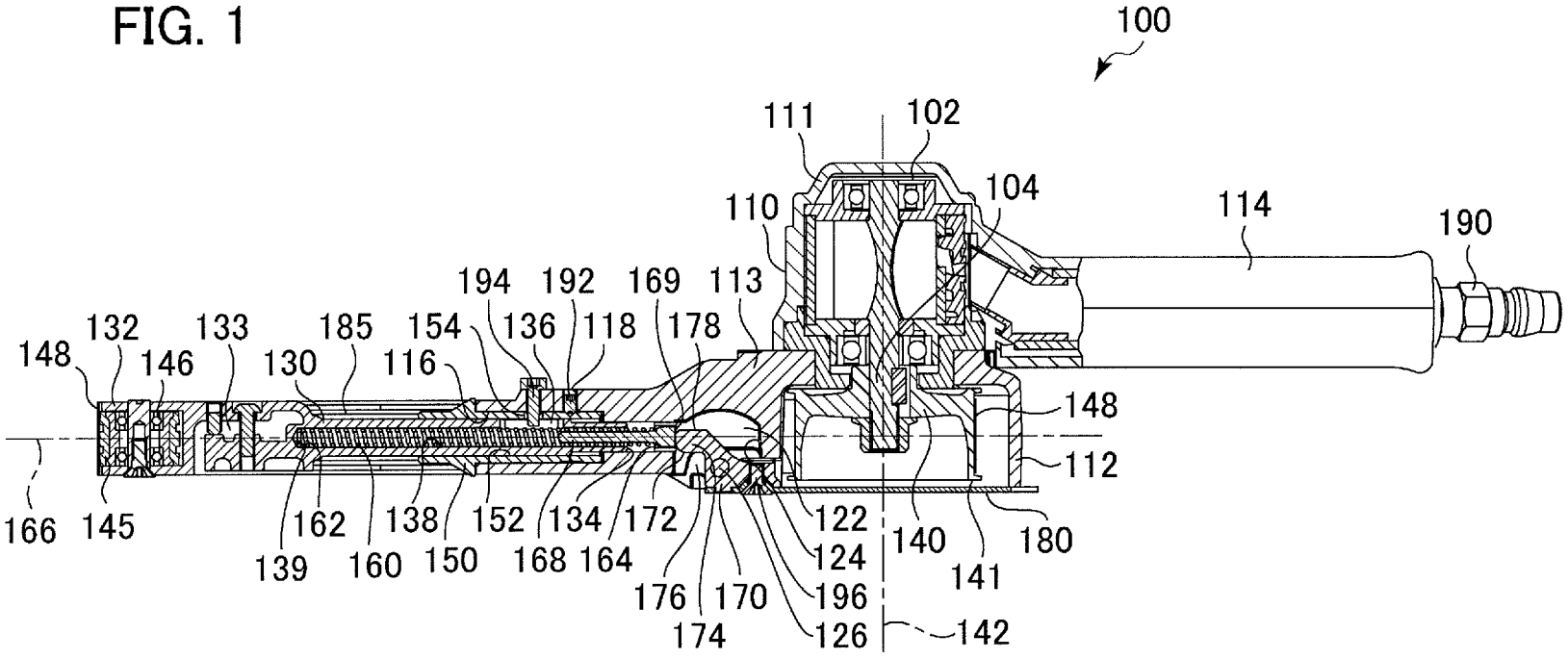
FIG. 1 is a plan view of a belt-type grinding tool according to a first embodiment of the present invention, in which main parts of the belt-type grinding tool are shown in sectional view.

A belt-type grinding tool 100 according to a first embodiment of the present invention has, as shown in FIG. 1, a tool body 110 accommodating an air motor 102 and a drive pulley 140, a pulley support bar 130 extending forward from the tool body 110 in a direction perpendicular to a rotation axis 142 of the drive pulley 140, and an idler pulley 145 rotatably attached to a front end portion 132 of the pulley support bar 130 through a bearing 146. An endless grinding belt 148 is wound around the drive pulley 140 and the idler pulley 145. The pulley support bar 130 is provided with a positioning mechanism at a position rearward of the idler pulley 145 to allow the position of the idler pulley when wound with the endless grinding belt to be adjusted in a sideward direction (vertical direction as seen in the figure). The air motor 102 is rotationally driven by compressed air supplied through a hose (not shown) from a compressed air source connected to a joint 190 provided at the rear end of a grip part 114, thereby rotationally driving the drive pulley 140 connected to an output shaft 104 of the air motor 102 to drive the endless grinding belt 148.

In the illustrated embodiment, the tool body 110 comprises a motor housing part 111 accommodating the air motor 102, a pulley housing part 112 accommodating the drive pulley 140, and a pulley support bar retaining part 113 extending forward from the pulley housing part 112 to support the pulley support bar 130. The pulley support bar retaining part 113 is provided with a bar housing hole 116 having a tubular sliding insert 150 inserted therein. The sliding insert 150 is secured to the pulley support bar retaining part 113 by a securing screw 192 screwed into a screw hole 118 extending through the pulley support bar retaining part 113 from a side surface thereof to the bar housing hole 116. The pulley support bar 130 is inserted into an inner bore 152 of the sliding insert 150, which has a smoothed surface, thereby being retained slidably in the longitudinal direction relative to the tool body 110. The pulley support bar 130 has a slot-shaped slide limiting hole 136 which is longitudinally extending and formed on a side surface of the pulley support bar 130. The pulley support bar retaining part 113 is provided with a positioning screw 194 inserted from the side surface thereof to extend into the slot-shaped slide limiting hole 136 of the pulley support bar 130 through a through-hole 154 in the sliding insert 150. The positioning screw 194 holds the pulley support bar 130 from rotating and also limits the longitudinal slidable range of the pulley support bar 130. The pulley support bar 130 is formed with a spring housing hole 138 extending forward from a rear end surface 134 thereof. The spring housing hole 138 is provided therein with a spring 160 for urging the pulley support bar 130 forwardly. The spring 160 has a front end portion 162 abutting against a front end surface 139 of the spring housing hole 138 and a rear end portion 164 extending rearward beyond the rear end surface 134 of the pulley support bar 130. The pulley support bar retaining part 113 has a spring support member housing space 122 rearward of the bar housing hole 116 to accommodate the spring support member 170 for supporting the spring 160 from a position rearward thereof. The spring support member 170 is installed pivotably about a pivot shaft 126 provided on the tool body 110, as will be explained below.

Figure 2:
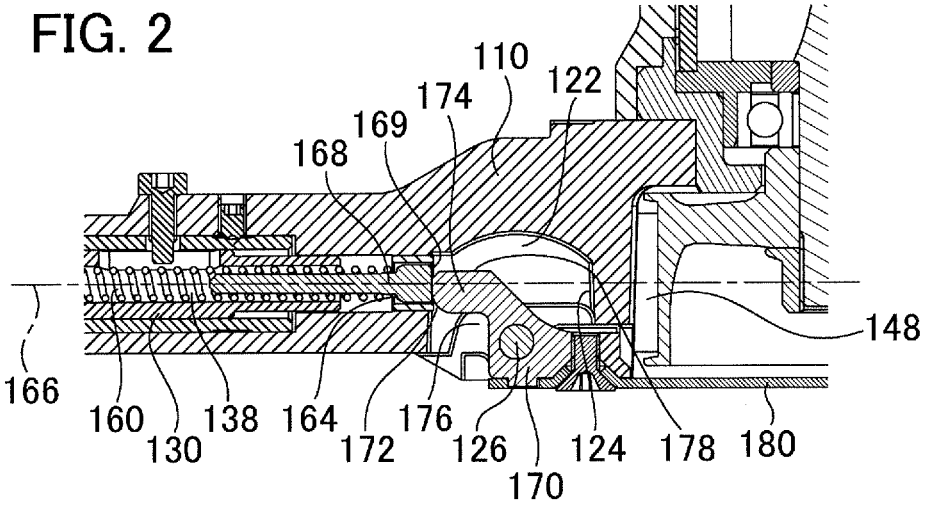
FIG. 2 is an enlarged view of a part of FIG. 1, showing a state where a spring support member of the belt-type grinding tool is in a first position.
Figure 3:
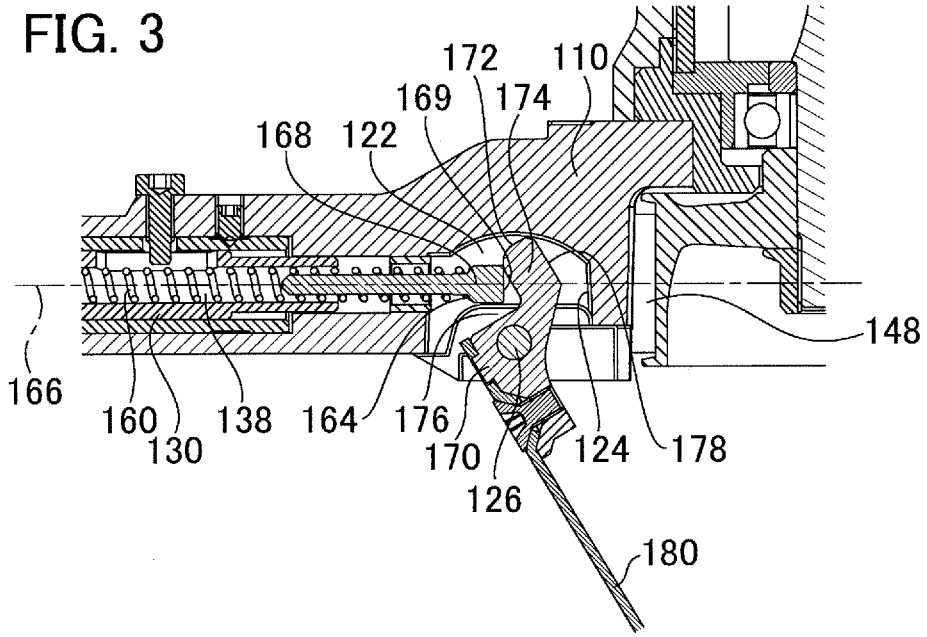
FIG. 3 is an enlarged view similar to FIG. 2, showing a state where the spring support member is halfway between the first and second positions.
Figure 4:
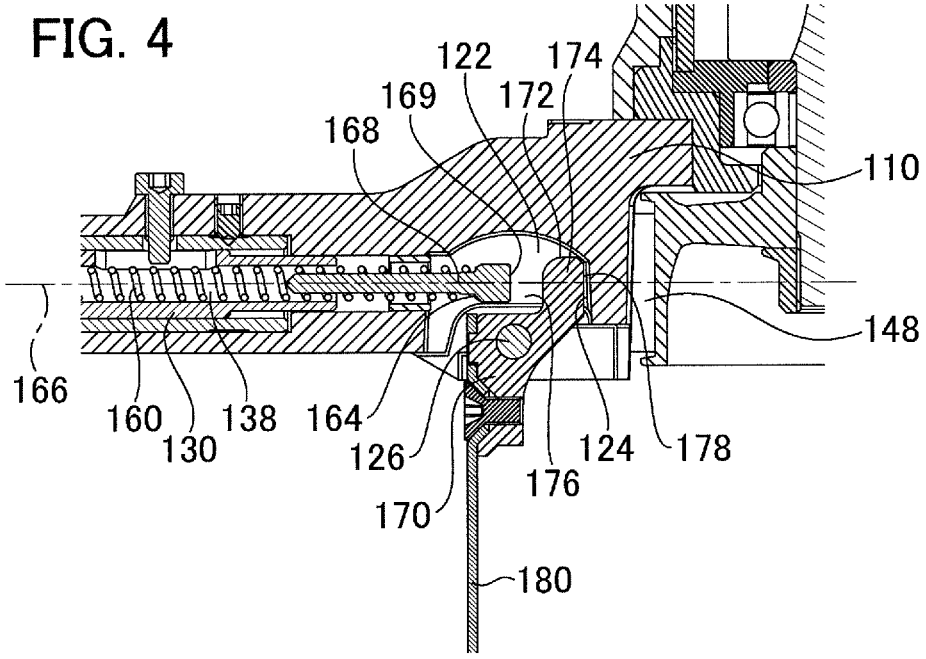
FIG. 4 is an enlarged view similar to FIG. 2, showing a state where the spring support member is in the second position.
Figure 6:
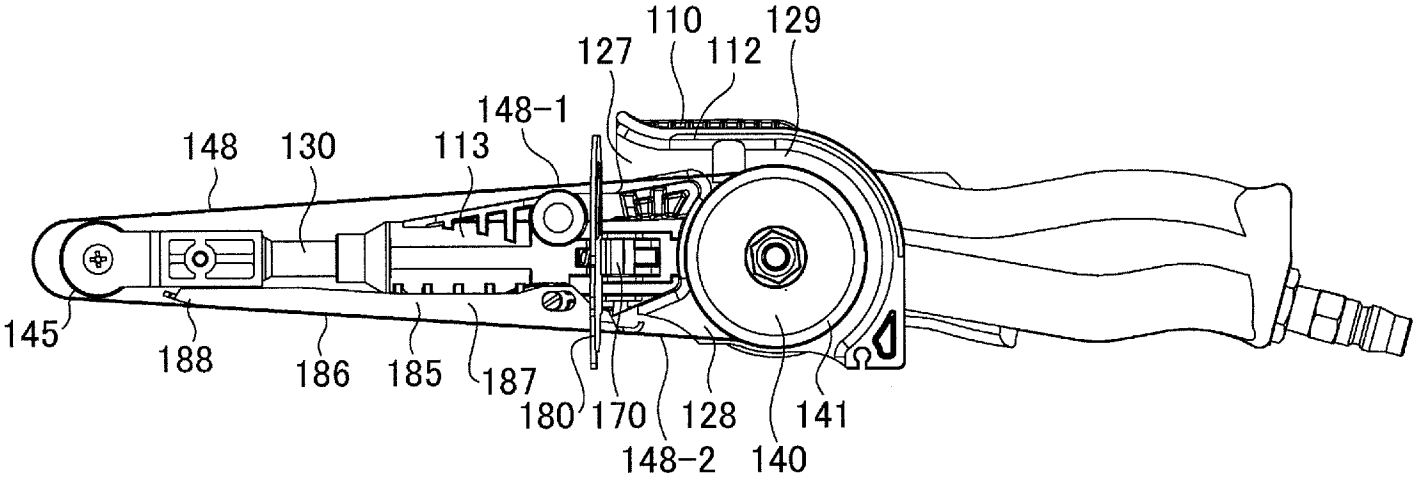
FIG. 6 is a side view similar to FIG. 5, showing a state where the spring support member is in the second position and the cover is open.

As shown in FIGS. 2 to 4, the spring support member 170 is pivotable from a first position shown in FIG. 2 to a second position shown in FIG. 4 about the pivot shaft 126, which is located at a position downwardly (as seen in the figures) displaced from a longitudinal axis 166 of the spring 160. The spring support member 170 has a spring support projection 174 having at a distal end thereof a spring support surface 172 engageable with a spring seat member 168 disposed on the rear end portion 164 of the spring 160. As shown in FIG. 2, when the spring support member 170 is in the first position, the spring support projection 174 faces toward the spring seat member 168, and the spring support surface 172 engages an engagement surface 169 of the spring seat member 168, which is the rear end surface of the spring seat member 168, to press the spring 160 forward. The spring 160 is compressed between the front end surface 139 (FIG. 1) of the spring housing hole 138 in the pulley support bar 130 and the spring support surface 172 of the spring support member 170 to urge the pulley support bar 130 forward relative to the tool body 110. With the urging force of the spring 160, the idler pulley 145 (FIG. 1) provided on the front end portion 132 (FIG. 1) of the pulley support bar 130 is pressed against the inner peripheral surface of the endless grinding belt 148 to apply a predetermined tension to the endless grinding belt 148. As the spring support member 170 is pivoted from the first position shown in FIG. 2 to the position shown in FIG. 3, the spring support surface 172, which acts as a cam, is gradually displaced rearward in sliding engagement with the spring seat member 168, thereby allowing the spring 160 to extend gradually. When the position shown in FIG. 3 is reached, the amount of compression of the spring 160 becomes almost zero. That is, the spring 160 is in its natural length. Therefore, there is no urging force pressing the pulley support bar 130 forward. Accordingly, the tension having been applied to the endless grinding belt 148 also disappears. When the spring support member 170 is further pivoted to the second position shown in FIG. 4, the spring seat member 168 disposed on the rear end portion 164 of the spring 160, which is now in its natural length, is received in a spring seat member receiving recess 176 of the spring support member 170, resulting in a predetermined gap being formed between the spring support member 170 and the spring seat member 168 in the direction of the longitudinal axis 166. Consequently, the pulley support bar 130 can retract rearward by a distance corresponding to the gap without compressing the spring 160, i.e. without receiving urging force. Retracting the pulley support bar 130 results, as shown in FIG. 6, in a gap between the endless grinding belt 148 and the idler pulley 145 or the drive pulley 140; therefore, it is possible to remove the endless grinding belt 148. In the second position shown in FIG. 4, the spring support member 170 is restricted from further pivoting clockwise as seen in the figures because an outer surface 178 of the spring support projection 174 engages a rear end surface 124 of the spring support member housing space 122. When the endless grinding belt 148 is to be tensioned, the spring support member 170 is pivoted from the second position shown in FIG. 4 counterclockwise as seen in the figures to engage the spring support surface 172 with the spring seat member 168 again, and while pressing the spring seat member 168 forward, the spring support member 170 is moved to the first position shown in FIG. 2. The spring 160 compressed in this way presses the pulley support bar 130 forward to apply a tension to the endless grinding belt 148, which is pressed by the idler pulley 145 (FIG. 1).

Figure 5:
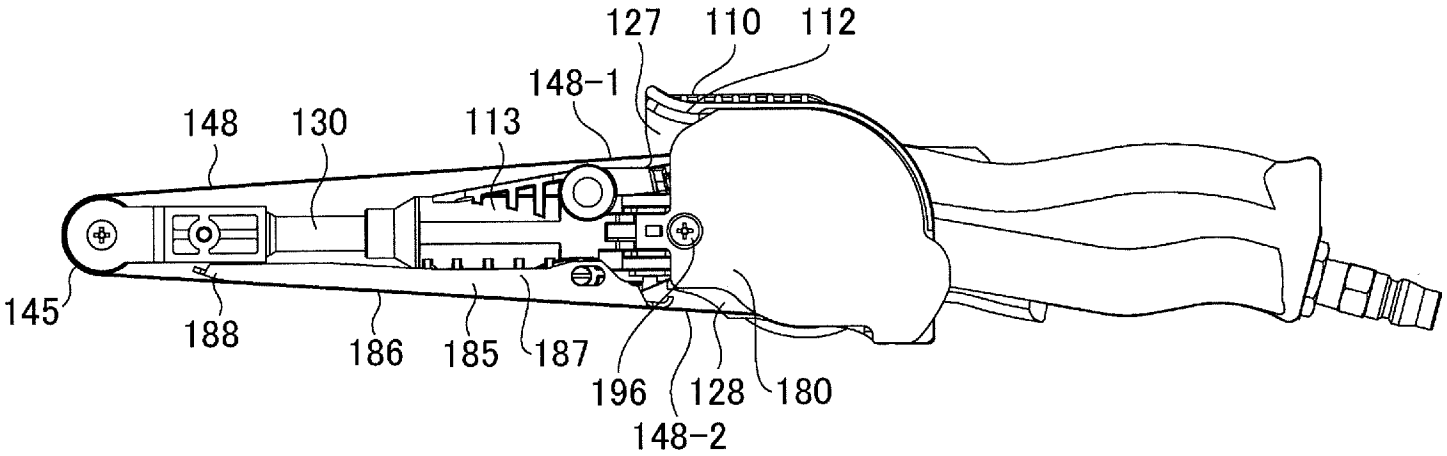
FIG. 5 is a side view of the belt-type grinding tool shown in FIG. 1, showing a state where the spring support member is in the first position and a cover is closed.

As shown in FIG. 6, the pulley housing part 112 of the tool body 110 is provided with a top front opening 127 for passage of an upper run portion 148-1 of the endless grinding belt 148 wound around the drive pulley 140 and the idler pulley 145, a bottom front opening 128 for passage of a lower run portion 148-2 of the endless grinding belt 148, and a side opening 129 opened contiguously with the top front opening 127 and the bottom front opening 128 to expose a side portion 141 of the drive pulley 140. The spring support member 170 has a cover 180 attached thereto with a cover securing screw 196 (FIG. 5). As the spring support member 170 pivots, the cover 180 also pivots, together with the spring support member 170, to open or close. As shown in FIG. 5, the cover 180, when the spring support member 170 is in the first position, closes to cover the side opening 129 of the pulley housing part 112, thereby restricting the access to the drive pulley 140. As shown in FIG. 6, when the spring support member 170 is in the second position, the cover 180 opens sideward to expose the side opening 129, thereby allowing the access to the drive pulley 140. Consequently, it becomes possible to remove or install the endless grinding belt 148 from or onto the drive pulley 140 through the side opening 129. Thus, an endless grinding belt 148 replacement operation can be performed.

In the conventional belt-type grinding tools, usually, the cover is an independent, separate component, which is removed and reinstalled by the worker every time an endless grinding belt replacement operation is performed. In addition, the endless grinding belt can be driven accidentally with the cover removed; therefore, if the worker performs such an erroneous operation, the endless grinding belt may be rotationally driven with the drive pulley exposed. In contract thereto, the belt-type grinding tool 100 according to this embodiment need not remove the cover 180 during an endless grinding belt replacement operation because the cover 180 is of the openable-closable type. Moreover, the workload is reduced because the endless grinding belt 148 is detensioned and tensioned at the same time as the cover 180 is opened and closed, respectively. In addition, the cover 180 covers the drive pulley 140 when the spring support member 170 is in the first position and hence the endless grinding belt 148 is tensioned to be ready to drive. Therefore, the drive pulley 140 is not exposed when the endless grinding belt 148 is being driven. Accordingly, it is also possible to reduce the possibility of a worker's hand or the like being caught between the drive pulley 140 being driven and the endless grinding belt 148. It should be noted that although this embodiment is not provided with a mechanism for holding the closed cover 180 in the closed position, the cover 180 when closed may be locked by using a hook or the like, thereby more surely preventing the cover 180 from opening accidentally during work or the like. Further, the cover 180 need not necessarily be attached to the spring support member 170 so as to pivot together therewith but may be attached to the tool body 110 separately from the spring support member 170.

As shown in FIGS. 5 and 6, a shoe 185 is provided at the lower side of the pulley housing part 112 of the tool body 110 to support the endless grinding belt 148 from the inner side. The shoe 185 is made of a rigid metal or the like into a U-shaped cross-sectional configuration comprising an elongated bottom wall portion 186 having a sliding surface adjacent to the lower run portion 148-2 of the endless grinding belt 148 and side wall portions 187 (one of them is hidden from view) extending upward along the opposite side edges of the bottom wall portion 186. The shoe 185 is fitted to the tool body 110, which is formed from a synthetic resin or the like with a view to weight reduction, in such a manner that the two side wall portions 187 sandwich a lower portion of the tool body 110 from both sides thereof. In this state, the shoe 185 is secured to the tool body 110 with a screw (not shown) from the other side of the figure, thereby reinforcing the rigidity of the tool body 110. As will be clear from FIG. 1, the surface of the side of the belt-type grinding tool 100 to which the cover 180 is attached has nothing projecting sideward and hence has a flat configuration as a whole unlike the surface of the opposite side of the belt-type grinding tool 100. Therefore, when a box-shaped object is to be ground, for example, a bottom portion near a side wall surface of the object can be ground smoothly without substantial interference with the side wall surface. In addition, a front end portion 188 of the shoe 185 is bent inward (upward as viewed in the figures), thereby preventing the distal end of the shoe 185 from being sharpened by sliding contact with the endless grinding belt 148.

Figure 7:
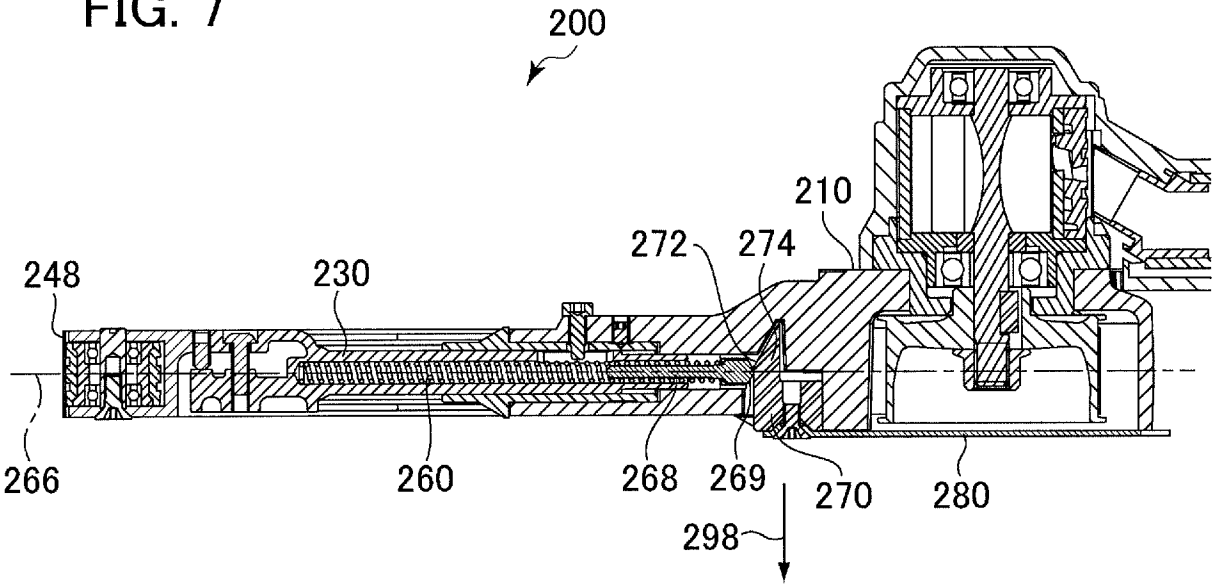
FIG. 7 is a sectional plan view of a belt-type grinding tool according to a second embodiment of the present invention.

FIG. 7 shows a belt-type grinding tool 200 according to a second embodiment of the present invention. In the belt-type grinding tool 200, a spring support member 270 and a cover 280 secured to the spring support member 270 are movable in a sideward direction 298 substantially perpendicularly crossing a longitudinal axis 266 of a spring 260. The spring support member 270, when pulled in the sideward direction 298, slides from a first position shown in FIG. 7 to a second position reached by moving from the first position in the sideward direction 298 by a distance equal to or slightly longer than the width of the endless grinding belt. The spring support member 270 has a spring support projection 274 formed in a wedge shape, and a spring support surface 272 is inclined to the longitudinal axis 266 of the spring 260. As the spring support member 270 is pulled from the first position toward the second position, a spring seat member 268 engaging the inclined spring support surface 272 gradually moves rearward along the spring support surface 272, thereby gradually releasing the compression of the spring 260. When the spring support member 270 is in the second position, the spring 260 extends to its natural length, and a pulley support bar 230 is slidable rearwardly without receiving urging force from the spring 260. In addition, the spring seat member 268 has an engagement surface 269 protruding toward the longitudinal axis 266. Therefore, the spring seat member 268 always engages the spring support surface 272 at the center thereof. In this embodiment also, the cover 280 is secured to the spring support member 270; therefore, there is no need to perform an extra operation for removing the cover 280 during an endless grinding belt 248 replacement operation, and there is no possibility of the endless grinding belt 248 being rotationally driven with the cover 280 open. It should be noted that the spring support member 270 and the cover 280 may be configured to be removable from the tool body 210 by being pulled in the sideward direction 298.

Figure 8:
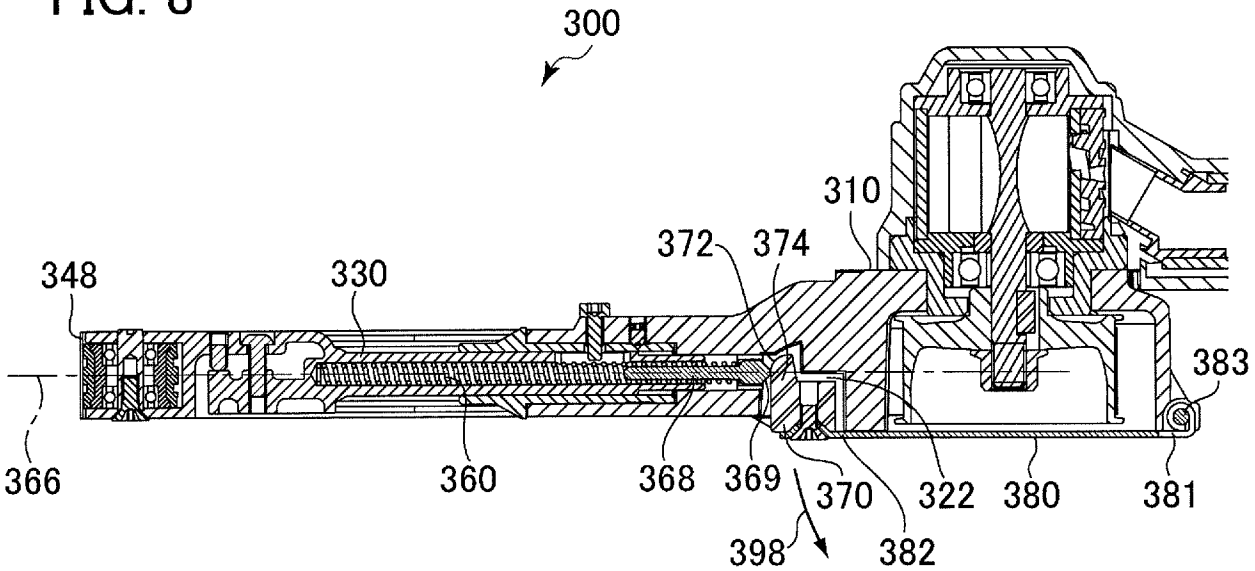
FIG. 8 is a sectional plan view of a belt-type grinding tool according to a third embodiment of the present invention.

FIG. 8 shows a belt-type grinding tool 300 according to a third embodiment of the present invention. The belt-type grinding tool 300 has a cover 380 pivotably attached at a rear end portion 381 thereof to a tool body 310 through a cover pivot shaft 383, and a spring support member 370 screwed to a front end portion 382 of the cover 380. The spring support member 370, together with the cover 380, moves in a sideward direction 398 about the cover pivot shaft 383, thereby being movable from a first position shown in FIG. 8 to a second position where the spring support member 370 is completely out of a spring support member housing space 322 in the tool body 310. The spring support member 370 has a spring support projection 374 formed in a wedge shape, and a spring support surface 372 forms an arcuately curved surface. As the spring support member 370 is pivoted from the first position toward the second position, a spring seat member 368 engaging the arcuate spring support surface 372 gradually moves rearward along the spring support surface 372, and the compression of a spring 360 is gradually released. When the spring support member 370 has been completely removed from the spring support member housing space 322, the spring 360 extends to its natural length, and a pulley support bar 330 is slidable rearwardly without receiving urging force from the spring 360. In addition, the spring seat member 368 has an engagement surface 369 protruding toward a longitudinal axis 366 as in the case of the second embodiment. In this embodiment also, the cover 380 is secured to the spring support member 370; therefore, there is no need to perform an extra operation for removing the cover 380 during an endless grinding belt 348 replacement operation, and there is no possibility of the endless grinding belt 348 being driven with the cover 380 open.

The belt-type grinding tool according to the present invention need not further compress the spring having been compressed to apply a tension to the endless grinding belt, which has been conventionally required, when moving the pulley support bar rearward for an endless grinding belt replacement operation, but allows the pulley support bar to be retracted in a state where the spring is in an extended position and hence the urging force is weak, preferably in a state where the spring is in its natural length and hence there is no urging force acting on the pulley support bar. Accordingly, the pulley support bar can be operated with a very small force. In addition, if the grinding tool is configured such that the spring is allowed to extend to its natural length, it is unnecessary to provide a lock mechanism for holding the pulley support bar in a retracted position against the urging force of the spring. Therefore, the structure of the tool can be further simplified, and the number of component parts can be reduced. It is also possible to simplify the assembly operation. Further, because the space capable of disposing the spring can be increased in the longitudinal direction owing to the elimination of the lock mechanism and so forth, it is possible to use a spring longer than in the conventional grinding tools. Consequently, it is possible to reduce the amount of change in urging force with respect to a change in the amount of compression of the spring in a state where a predetermined tension is being applied to the endless grinding belt. Accordingly, the change in tension applied to the endless grinding belt can be suppressed to a relatively small extent even if the amount of compression of the spring changes due to a change in the circumferential length of the endless grinding belt as a result of stretching thereof, for example.

It should be noted that, although the foregoing embodiments show the spring support member 170 that pivots to move between the first position and the second position and the spring support members 270 and 370 that move laterally of the tool body to move between the first and second positions, the direction of movement of the spring support member is not limited to the above. For example, the spring support member may be configured to move in the longitudinal direction of the longitudinal axis of the spring. Further, the drive pulley may be driven by using an electric motor in place of an air motor.

What is claimed is:

1. A belt-type grinding tool comprising:

a tool body;

a drive pulley provided in the tool body and rotationally driven by a motor;

an idler pulley provided at a position separated forward from the drive pulley to stretch an endless grinding belt between the idler pulley and the drive pulley;

a pulley support bar having a front end portion rotatably supporting the idler pulley, the pulley support bar extending rearward from the front end portion and being supported by the tool body;

a spring urging the pulley support bar forward relative to the tool body, thereby causing the idler pulley supported by the pulley support bar to press the endless grinding belt forward to apply a tension to the endless grinding belt;

a spring support member movably attached to the tool body, the spring support member being movable between a first position where the spring support member supports the spring in such a manner that the spring is compressed between the spring support member and the pulley support bar to apply a tension to the endless grinding belt, and a second position where the spring support member is displaced from the first position to reduce an amount of compression of the spring to reduce the tension; and a cover attached to the spring support member;

wherein the tool body further comprises a top front opening for passage of an upper run portion of the endless grinding belt wound around the drive pulley and the idler pulley, a bottom front opening for passage of a lower run portion of the endless grinding belt, and a side opening opened contiguously with the top front opening and the bottom front opening to expose a side portion of the drive pulley; and wherein the cover is configured such that when the spring support member is in the first position, the cover covers the side opening, and when the spring support member is in the second position, the cover exposes the side opening to allow access to the drive pulley, thereby allowing the endless grinding belt to be mounted around and removed from the drive pulley through the side opening.

2. The belt-type grinding tool of claim 1, wherein the spring support member when in the second position does not press the spring so that the pulley support bar is movable rearward without compressing the spring.

3. The belt-type grinding tool of claim 1, wherein the spring support member is pivotable about a pivot shaft provided on the tool body so that the spring support member is movable between the first position and the second position by pivoting about the pivot shaft.

4. The belt-type grinding tool of claim 3, wherein the pivot shaft is located at a position displaced from a longitudinal axis of the spring.

5. The belt-type grinding tool of claim 1, wherein the spring support member is movable in a transverse direction crossing a longitudinal axis of the spring so that the spring support member is movable between the first position and the second position by moving in the transverse direction.

6. The belt-type grinding tool of claim 1, wherein the pulley support bar has a spring housing hole extending forward from a rear end surface of the pulley support bar and having a front end surface in the pulley support bar;

wherein the spring is accommodated in the spring housing hole such that a front end portion of the spring abuts against the front end surface of the spring housing hole.

7. The belt-type grinding tool of claim 1, further comprising:

a spring seat member engageable with a rear end portion of the spring;

wherein the spring support member when in the first position engages the spring seat member to press the spring through the spring seat member.

8. The belt-type grinding tool of claim 2, wherein the spring support member is pivotable about a pivot shaft provided on the tool body so that the spring support member is movable between the first position and the second position by pivoting about the pivot shaft.

9. The belt-type grinding tool of claim 2, wherein the spring support member is movable in a transverse direction crossing a longitudinal axis of the spring so that the spring support member is movable between the first position and the second position by moving in the transverse direction.

10. A belt-type grinding tool comprising:

a tool body;

a drive pulley provided in the tool body and rotationally driven by a motor;

an idler pulley provided at a position separated forward from the drive pulley to stretch an endless grinding belt between the idler pulley and the drive pulley;

a pulley support bar having a front end portion rotatably supporting the idler pulley, the pulley support bar extending rearward from the front end portion and being supported by the tool body;

a spring urging the pulley support bar forward relative to the tool body, thereby causing the idler pulley supported by the pulley support bar to press forward the endless grinding belt to result in applying a tension to the endless grinding belt; and a spring support member movably attached to the tool body, the spring support member being movable between a first position where the spring support member supports the spring in such a manner that the spring is compressed between the spring support member and the pulley support bar to apply a tension to the endless grinding belt, and a second position where the spring support member is displaced from the first position to reduce an amount of compression of the spring to reduce the tension;

wherein the spring is a coil spring extending in a front-back direction defining a longitudinal axis; and, wherein the spring support member is rotatable about a pivotal axis spaced apart rearward from a rear end of the coil spring and laterally from the longitudinal axis, and comprises a first portion provided around the pivotal axis and extending radially relative to the pivotal axis and a second portion projecting laterally from the first portion to define a corner space between the first and second portions so that, wherein when in the first position, the first portion extends from the pivotal axis toward the longitudinal axis and the second portion extends from the first portion along the longitudinal axis with a tip end surface of the second portion engaged with the rear end of the coil spring to compress the coil spring and, when in the second position, the tip end of the second portion is disengaged from the rear end surface of the coil spring to allow the coil spring to extend rearward into the corner space.

11. The belt-type grinding tool of claim 10, wherein the spring support member when in the second position does not press the spring so that the pulley support bar is movable rearward without compressing the spring.

12. The belt-type grinding tool of claim 10, further comprising:

a cover attached to the spring support member;

wherein the tool body further comprises a top front opening for passage of an upper run portion of the endless grinding belt wound around the drive pulley and the idler pulley, a bottom front opening for passage of a lower run portion of the endless grinding belt, and a side opening opened contiguously with the top front opening and the bottom front opening to expose a side portion of the drive pulley; and wherein the cover is configured such that when the spring support member is in the first position, the cover covers the side opening, and when the spring support member is in the second position, the cover exposes the side opening to allow access to the drive pulley, thereby allowing the endless grinding belt to be mounted around and removed from the drive pulley through the side opening.

13. The belt-type grinding tool of claim 10, wherein the pulley support bar has a spring housing hole extending forward from a rear end surface of the pulley support bar and having a front end surface in the pulley support bar;

wherein the spring is accommodated in the spring housing hole such that a front end portion of the spring abuts against the front end surface of the spring housing hole.

14. The belt-type grinding tool of claim 10, further comprising:

a spring seat member engageable with a rear end portion of the spring;

wherein the spring support member when in the first position engages the spring seat member to press the spring through the spring seat member.

* * * * *